US006185883B1

(12) United States Patent
Howard

(10) Patent No.: US 6,185,883 B1
(45) Date of Patent: Feb. 13, 2001

(54) WINDOW WITH DECORATIVE ACCESSORIES

(76) Inventor: Noel Howard, 8 Emerald Street, Dublin 1 (IE)

( * ) Notice: Under 35 U.S.C. 154(b), the term of this patent shall be extended for 0 days.

(21) Appl. No.: 09/224,319

(22) Filed: Dec. 31, 1998

(51) Int. Cl.[7] ..... E06B 3/66

(52) U.S. Cl. ..... 52/204.59; 52/311.1; 52/786.1; 52/308; 40/546; 362/31; 362/145

(58) Field of Search ..... 52/311.1, 204.59, 52/171.1, 786.1, 786.11, 308; 40/546, 714; 428/34; 362/31, 145, 812

(56) References Cited

U.S. PATENT DOCUMENTS

| | | | | |
|---|---|---|---|---|
| 1,953,555 | * | 4/1934 | Frey et al. | 362/31 X |
| 3,226,903 | * | 1/1966 | Lillethun | 52/172 |
| 3,460,303 | * | 8/1969 | Algrain et al. | 52/308 X |
| 5,027,258 | * | 6/1991 | Schoniger et al. | 362/31 |
| 5,205,884 | * | 4/1993 | Rauscher | 52/311.1 |
| 5,313,724 | * | 5/1994 | Warner | 362/223 |
| 5,371,656 | * | 12/1994 | Iorfida | 362/31 |
| 5,494,715 | * | 2/1996 | Glover | 428/34 |
| 5,546,687 | * | 8/1996 | Iorfida | 40/546 |
| 5,555,654 | * | 9/1996 | Hermann | 362/31 X |
| 5,884,441 | * | 3/1999 | Monroe, Jr. et al. | 52/308 X |

FOREIGN PATENT DOCUMENTS

| | | | | |
|---|---|---|---|---|
| 936459 | * | 7/1948 | (FR) | 40/546 |
| 1051814 | * | 1/1954 | (FR) | 40/546 |
| 850120 | * | 9/1960 | (GB) | 40/546 |
| 2137680 | * | 10/1984 | (GB) | 52/204.59 |
| 2149657 | * | 6/1985 | (GB) | 40/714 |

* cited by examiner

*Primary Examiner*—Laura A. Callo

(57) ABSTRACT

A window with decorative accessories for providing a decorative structure while increasing energy efficiency. The window with decorative accessories includes a window frame that has a pair of spaced apart lateral members and upper and lower members extending between the lateral members. Spaced apart first and second panes of glass are mounted in the window frame. A third pane of glass has a plurality of decorative accessories thereon. The third pane is disposed between the first and second panes.

16 Claims, 2 Drawing Sheets

31
30
32

56
57
62
51
61
60
58
52
54
32
64
66

WINDOW WITH DECORATIVE ACCESSORIES

BACKGROUND OF THE INVENTION

1. Field of the Invention

The present invention relates to decorative windows and more particularly pertains to a new window with decorative accessories for providing a decorative structure while increasing energy efficiency.

2. Description of the Prior Art

The use of decorative windows is known in the prior art. More specifically, decorative windows heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,160,566; U.S. Pat. No. 5,333,428; U.S. Pat. No. Des. 317,655; U.S. Pat. No. 5,516,387; U.S. Pat. No. 2,991,213; and U.S. Pat. No. 3,460,303.

While these devices fulfill their respective, particular objectives and requirements, the aforementioned patents do not disclose a new window with decorative accessories. The inventive device includes a window frame that has a pair of spaced apart lateral members and upper and lower members extending between the lateral members. Spaced apart first and second panes of glass are mounted in the window frame. A third pane of glass has a plurality of decorative accessories thereon. The third pane is disposed between the first and second panes.

In these respects, the window with decorative accessories according to the present invention substantially departs from the conventional concepts and designs of the prior art, and in so doing provides an apparatus primarily developed for the purpose of providing a decorative structure while increasing energy efficiency.

SUMMARY OF THE INVENTION

In view of the foregoing disadvantages inherent in the known types of decorative windows now present in the prior art, the present invention provides a new window with decorative accessories construction wherein the same can be utilized for providing a decorative structure while increasing energy efficiency.

The general purpose of the present invention, which will be described subsequently in greater detail, is to provide a new window with decorative accessories apparatus and method which has many of the advantages of the decorative windows mentioned heretofore and many novel features that result in a new window with decorative accessories which is not anticipated, rendered obvious, suggested, or even implied by any of the prior art decorative windows, either alone or in any combination thereof.

To attain this, the present invention generally comprises a window frame that has a pair of spaced apart lateral members and upper and lower members extending between the lateral members. Spaced apart first and second panes of glass are mounted in the window frame. A third pane of glass has a plurality of decorative accessories thereon. The third pane is disposed between the first and second panes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new window with decorative accessories apparatus and method which has many of the advantages of the decorative windows mentioned heretofore and many novel features that result in a new window with decorative accessories which is not anticipated, rendered obvious, suggested, or even implied by any of the prior art decorative windows, either alone or in any combination thereof.

It is another object of the present invention to provide a new window with decorative accessories which may be easily and efficiently manufactured and marketed.

It is a further object of the present invention to provide a new window with decorative accessories which is of a durable and reliable construction.

An even further object of the present invention is to provide a new window with decorative accessories which is susceptible of a low cost of manufacture with regard to both materials and labor, and which accordingly is then susceptible of low prices of sale to the consuming public, thereby making such window with decorative accessories economically available to the buying public.

Still yet another object of the present invention is to provide a new window with decorative accessories which provides in the apparatuses and methods of the prior art some of the advantages thereof, while simultaneously overcoming some of the disadvantages normally associated therewith.

Still another object of the present invention is to provide a new window with decorative accessories for providing a decorative structure while increasing energy efficiency.

Yet another object of the present invention is to provide a new window with decorative accessories which includes a window frame that has a pair of spaced apart lateral members and upper and lower members extending between the lateral members. Spaced apart first and second panes of glass are mounted in the window frame. A third pane of glass has a plurality of decorative accessories thereon. The third pane is disposed between the first and second panes.

Still yet another object of the present invention is to provide a new window with decorative accessories that has an interchangeable third pane of glass disposed between two outer panes.

Even still another object of the present invention is to provide a new window with decorative accessories that has illuminating means with adjustable intensity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
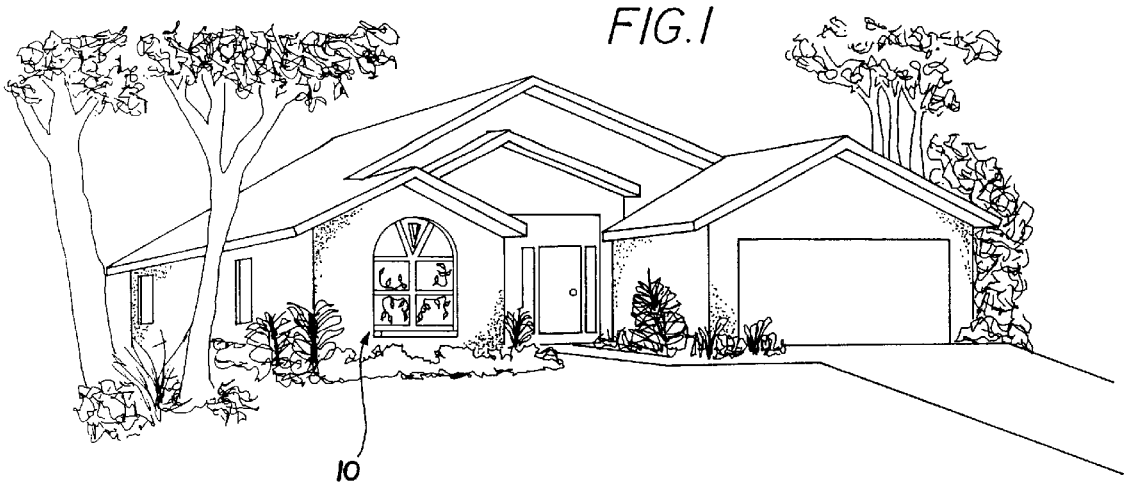
FIG. 1 is a schematic perspective view of a new window with decorative accessories according to the present invention.
Figure 2:
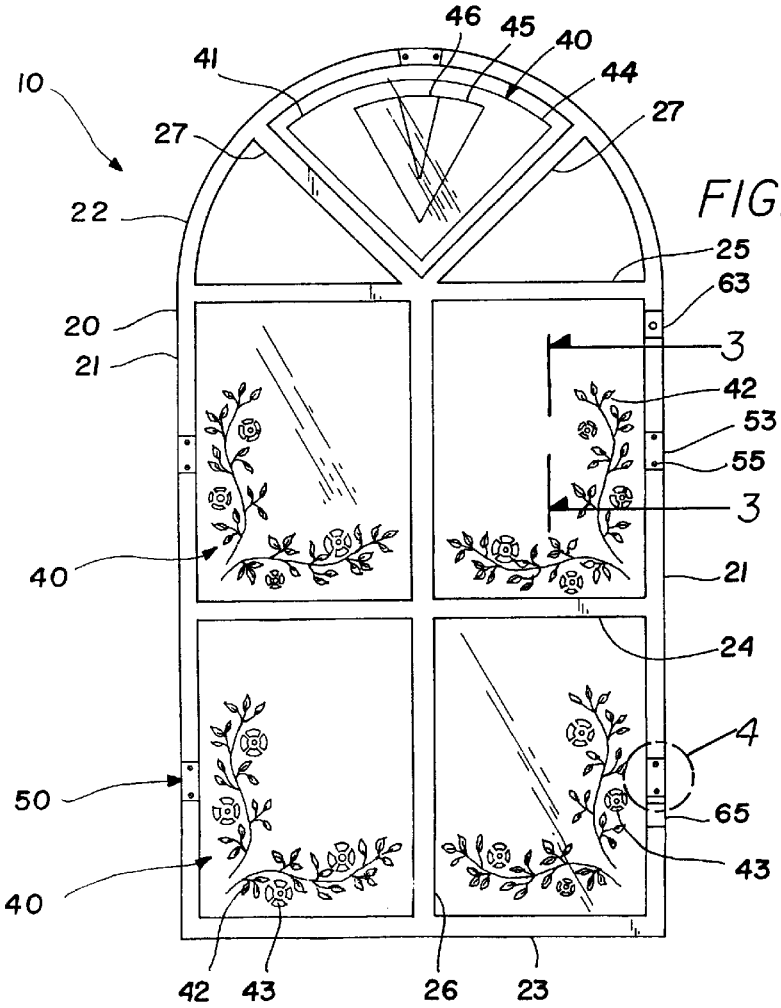
FIG. 2 is a schematic side view of the present invention.
Figure 3:
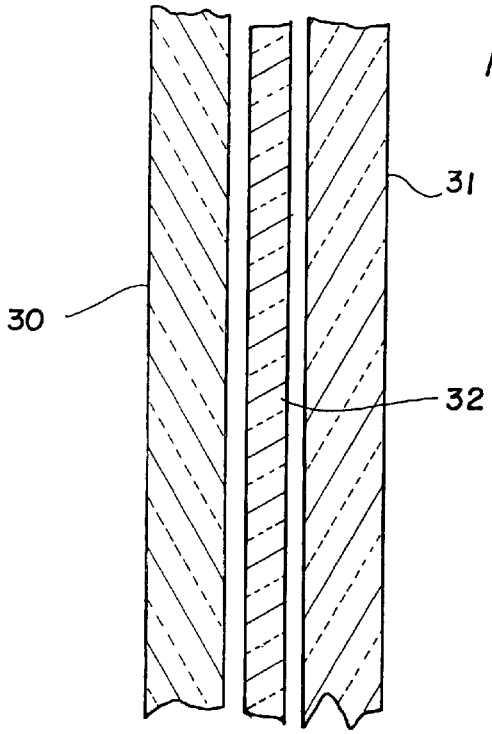
FIG. 3 is a schematic cross sectional view of the present invention taken from line 3—3 of FIG. 2.

With reference now to the drawings, and in particular to FIGS. 1 through 4 thereof, a new window with decorative accessories embodying the principles and concepts of the present invention and generally designated by the reference numeral 10 will be described.

As best illustrated in FIGS. 1 through 4, the window with decorative accessories 10 generally comprises a window frame 20 that has a pair of spaced apart lateral members 21 and upper and lower members 22,23 extending between the lateral members 21. Spaced apart first and second panes 30,31 of glass are mounted in the window frame 20. A third pane 32 of glass has a plurality of decorative accessories 40 thereon. The third pane 32 is disposed between the first and second panes 30,31.

Preferably, the first pane 30 is mounted in the window frame 20 while the second pane 31 is removably mounted in the window frame 20. The third pane 32 is removably disposed between the first and second panes 30,31. This permits periodic exchanging of the third pane 32 with another pane with different decorative accessories 40. For example, a pane with seasonal decorative accessories 40 may be disposed between the first and second panes 30,31 during a holiday season.

Preferably, a first portion of the decorative accessories 40 comprise stained glass inserts 41 disposed in the third pane 32. A second portion of the decorative accessories 40 comprise painted patterns 42 painted on the third pane 32. A third portion of the decorative accessories 40 comprise decals 43 coupled to the third pane 32. Ideally, paint of the painted patterns 42 is translucent such that it is illuminated by the illuminating means 60, discussed more fully below, such that it has a glowing appearance. Also ideally, the decals 43 are removable so that the theme of the decoration may be changed.

Figure 4:
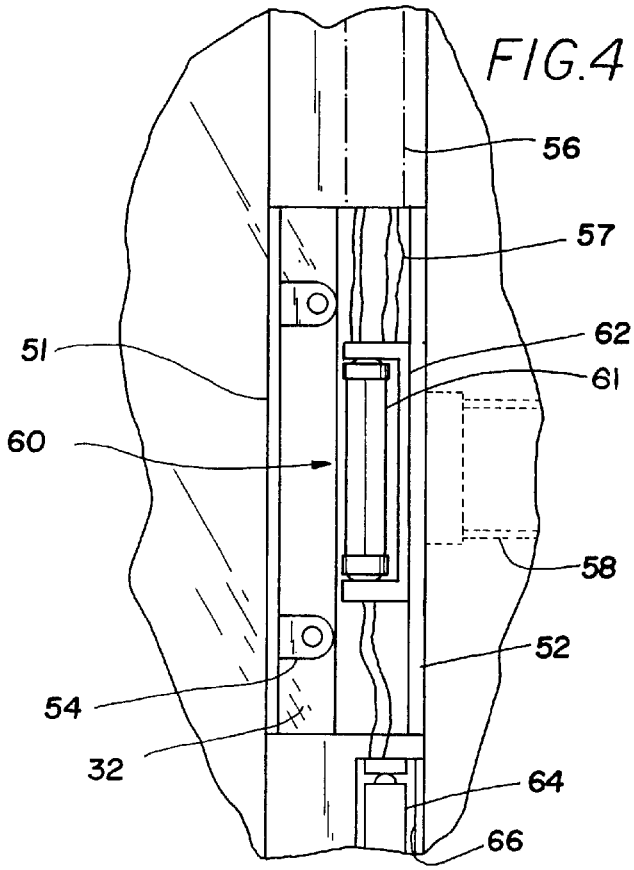
FIG. 4 is a schematic detailed view of the present invention taken from circle 4—4 of FIG. 2.

Preferably, as shown in FIG. 4, each of the lateral members 21 of the window frame 20 has a cutout portion 50 defined between a pair of inner panels 51 and an outer panel 52. Each of the inner panels 51 extends along an inner side of a respective lateral member 21. Each of the outer panels 52 extends along an outer side of a respective lateral member 21. The third pane 32 extends through associated pairs of inner panels 51 into the cutout portions 50. An illuminating means 60 is disposed in each of the cutout portions 50 of the lateral members 21 of the window frame 20. Each of the illuminating means 60 projects light between the first and second panes 30,31 to illuminate the third pane 32. Ideally, each of the illuminating means 60 comprises an bulb 61 that is disposed in a socket 62 and in communication with a switch 63. The switch 63 is in communication with a power source.

Most ideally, each of the bulbs 61 is elongate and generally tubular and a longitudinal length of each of the bulbs 61 extends along a peripheral edge of the third pane 32. Each of the sockets 62 of the illuminating means 60 is coupled to an associated outer panel 52. Also most ideally, the switch 63 comprises a dimmer switch 63 of a type known in the art.

Also most ideally, each of the lateral members 21 has an access plate 53 that is removably coupled to it and closes the cutout portions 50. Most ideally, one inner panel of each of the inner panels 51 has a pair of flanges 54 extending from it. Each of the flanges 54 has an aperture that extends through it. A threaded fastener 55 extends through each of the apertures in the flanges 54 to removably couple the access plates 53 to the flanges 54.

Ideally, the power source comprises a battery 64. Most ideally, the battery 64 is disposed in a cavity 66 in one of said lateral members 21 of said window frame 20. A battery cover 65 covers the cavity 66. Battery power is particularly useful where the window frame 20 forms part of a sliding door or opens window, where wires extends from the window frame 20 would be impractical or possibly dangerous. However, the power source may also comprise regular alternating current common in most households. FIG. 4 illustrates wires 58 for coupling to a structure's wiring system.

Also ideally, the lateral members 21 and the upper and lower members 22,23 each have a generally cylindrical channel 56 that extends through it along a length thereof. A plurality of wires 57 extend between the switch 63 and the illuminating means 60 and are disposed in the channels 56.

Preferably, a first horizontal cross member 24 extends between center portions of the lateral members 21 of the window frame 20. A second horizontal cross member 25 extends between upper ends of the lateral members 21. A vertical cross member 26 extends between center portions of the upper and lower members 22,23. Ideally, portions of the third pane 32 disposed between the lateral sides and the vertical cross member 26 each have decorative accessories 40 thereon. Most ideally, the decorative accessories 40 comprise painted patterns 42 and decals 43 to permit more view through the third pane 32 than would be possible if the decorative accessories comprised stained glass.

More preferably, the upper member 22 is generally semicircular and has an illuminating means 60 disposed in an uppermost portion thereof. A pair of opposed angled cross members 27 extend between the upper member 22 and the second horizontal cross member 25 towards a point of intersection of the vertical cross member 26 and the second horizontal cross member 25. The angle between each of the angled cross members 27 and the second horizontal cross member 25 is between about 20 and 70 degrees, ideally about 50 degrees. Ideally, a portion of the third pane 32 disposed between the angled cross members 27 and the upper member 22 has a generally triangular first stained glass insert 44, a generally triangular second stained glass insert 45 positioned inwardly of the first stained glass insert 44, and a generally triangular third stained glass insert 46 positioned inwardly of the second stained glass insert 45.

In use, the second pane 31 is removed from the window frame 20. A third pane 32 is disposed adjacent the first pane 30 and the second pane 31 is remounted to the window frame 20. The dimmer switch 63 is used to adjust the intensity of the light emanating from the illuminating means 60. When a bulb 61 burns out, the threaded fasteners 55 are removed to release the access plate 53 and the bulb is changed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A window with decorative accessories adapted for mounting to a structure, comprising:

a window frame having a pair of spaced apart lateral members and upper and lower members extending between said lateral members;

spaced apart first and second panes of glass being mounted in said window frame;

a third pane of glass having a plurality of decorative accessories thereon, said third pane being disposed between said first and second panes;

wherein each of said lateral members of said window frame has a cutout portion defined between a pair of inner panels and an outer panel, each of said inner panels extending along an inner side of a respective lateral member, each of said outer panels extending along an outer side of each of said lateral members, said third pane extending through associated pairs of inner panels into said cutout portions, an illuminating means being disposed in each of said cutout portions of said lateral members of said window frame, each of said illuminating means being for projecting light between said first and second panes for illuminating said third pane; and wherein each of said illuminating means comprises an elongate generally tubular bulb being disposed in a socket and in communication with a switch, said switch being in communication with a power source.

2. The window with decorative accessories of claim 1, wherein said decorative accessories comprise stained glass inserts disposed in said third pane.

3. The window with decorative accessories of claim 1, wherein said decorative accessories comprise painted patterns painted on said third pane.

4. The window with decorative accessories of claim 1, wherein said decorative accessories comprise decals coupled to said third pane.

5. The window with decorative accessories of claim 1, wherein a longitudinal length of each of said bulbs extends along a peripheral edge of said third pane.

6. The window with decorative accessories of claim 1, wherein said switch comprises a dimmer switch.

7. The window with decorative accessories of claim 1, wherein each of said lateral members has an access plate being removably coupled thereto for closing said cutout portions.

8. The window with decorative accessories of claim 7, wherein one of said inner panels of each of said pairs of inner panels has a pair of flanges extending therefrom, each of said flanges having an aperture extending therethrough, a pair of threaded fasteners extending through said apertures in said flanges for removably coupling said access plates to said flanges.

9. The window with decorative accessories of claim 1, wherein said power source comprises a battery.

10. The window with decorative accessories of claim 1, wherein said lateral members and said upper and lower members each have a generally cylindrical channel extending therethrough along a length thereof, a plurality of wires extending between said switch and said illuminating means and being disposed in said channels.

11. The window with decorative accessories of claim 1, wherein a first horizontal cross member extends between center portions of said lateral members of said window frame, a second horizontal cross member extending between upper ends of said lateral members, wherein a vertical cross member extends between center portions of said lower and second horizontal cross members, wherein portions of said third pane disposed between said lateral sides and said vertical cross member each have decorative accessories thereon, said decorative accessories comprising painted patterns and decals.

12. The window with decorative accessories of claim 8, wherein said upper member is generally semicircular and has an illuminating means disposed in an uppermost portion thereof, wherein a pair of opposed angled cross members extend between said upper member and said second horizontal cross member towards a point of intersection of said vertical cross member and said second horizontal cross member, the angle between each of said angled cross members and said second horizontal cross member is between about 20 and 70 degrees, wherein a portion of said third pane disposed between said angled cross members and said upper member has a generally triangular first stained glass insert, a generally triangular second stained glass insert positioned inwardly of said first stained glass insert, and a generally triangular third stained glass insert positioned inwardly of said second stained glass insert.

13. The window with decorative accessories of claim 1, wherein said first pane is fixedly mounted in said window frame, said second pane being removably mounted in said window frame, said third pane being removably disposed between said first and second panes.

14. The window with decorative accessories of claim 1:

said second pane being removably mounted in said window frame;

wherein a first portion of said decorative accessories comprise stained glass inserts disposed in said third pane;

wherein a second portion of said decorative accessories comprise painted patterns painted on said third pane;

wherein a third portion of said decorative accessories comprise decals coupled to said third pane;

said illuminating means in communication with a dimmer switch, said dimmer switch being in communication with said power source;

a longitudinal length of each of said bulbs extending along a peripheral edge of said third pane;

each of said sockets of said illuminating means being coupled to an associated outer panel;

each of said lateral members having an access plate being removably coupled thereto and closing said cutout portions;

wherein one of said inner panels of each of said pairs of inner panels has a pair of flanges extending therefrom, each of said flanges having an aperture extending therethrough, a pair of threaded fasteners extending through said apertures of each of said flanges for removably coupling said access plates to said flanges;

wherein said power source comprises a battery;

wherein said lateral members and said upper and lower members each have a generally cylindrical channel extending therethrough along a length thereof, a plurality of wires extending between said switch and said illuminating means and being disposed in said channels;

wherein a first horizontal cross member extends between center portions of said lateral members of said window frame, a second horizontal cross member extending between upper ends of said lateral members;

wherein a vertical cross member extends between center portions of said lower and second horizontal cross members;

wherein said upper member is generally semicircular and has an illuminating means disposed in an uppermost portion thereof;

wherein a pair of opposed angled cross members extend between said upper member and said second horizontal cross member towards a point of intersection of said vertical cross member and said second horizontal cross member, the angle between each of said angled cross members and said second horizontal cross member is between about 20 and 70 degrees;

wherein a portion of said third pane disposed between said angled cross members and said upper member has a generally triangular first stained glass insert, a generally triangular second stained glass insert positioned inwardly of said first stained glass insert, and a generally triangular third stained glass insert positioned inwardly of said second stained glass insert; and wherein portions of said third pane disposed between said lateral sides and said vertical cross member each have decorative accessories thereon, said decorative accessories comprising painted patterns and decals.

15. A window with decorative accessories adapted for mounting to a structure, comprising:

a window frame having a pair of spaced apart lateral members and upper and lower members extending between said lateral members;

spaced apart first and second panes of glass being mounted in said window frame;

a third pane of glass having a plurality of decorative accessories thereon, said third pane being disposed between said first and second panes;

wherein each of said lateral members of said window frame has a cutout portion defined between a pair of inner panels and an outer panel, each of said inner panels extending along an inner side of a respective lateral member, each of said outer panels extending along an outer side of each of said lateral members, said third pane extending through associated pairs of inner panels into said cutout portions, an illuminating means being disposed in each of said cutout portions of said lateral members of said window frame, each of said illuminating means being for projecting light between said first and second panes for illuminating said third pane; and wherein each of said lateral members has an access plate being removably coupled thereto for closing said cutout portions.

16. A window with decorative accessories adapted for mounting to a structure, comprising:

a window frame having a pair of spaced apart lateral members and upper and lower members extending between said lateral members;

spaced apart first and second panes of glass being mounted in said window frame;

a third pane of glass having a plurality of decorative accessories thereon, said third pane being disposed between said first and second panes; and wherein said first pane is fixedly mounted in said window frame, said second pane being removably mounted in said window frame, said third pane being removably disposed between said first and second panes.

* * * * *